US008608301B2

(12) United States Patent
Oguchi

(10) Patent No.: US 8,608,301 B2
(45) Date of Patent: Dec. 17, 2013

(54) LIQUID EJECTING HEAD AND LIQUID EJECTING APPARATUS

(75) Inventor: Satoshi Oguchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/047,692

(22) Filed: Mar. 14, 2011

(65) Prior Publication Data

US 2011/0221838 A1 Sep. 15, 2011

(30) Foreign Application Priority Data

Mar. 15, 2010 (JP) ..... 2010-058532

(51) Int. Cl.
*B41J 2/19* (2006.01)

(52) U.S. Cl.
USPC ..... 347/92

(58) Field of Classification Search
USPC ..... 347/92, 93
See application file for complete search history.

(56) References Cited

U.S. PATENT DOCUMENTS

| | | | | |
|---|---|---|---|---|
| 6,190,009 | B1 | 2/2001 | Kitahara | |
| 7,040,742 | B2 * | 5/2006 | Tobinai et al. | 347/85 |
| 7,121,658 | B2 * | 10/2006 | Platt et al. | 347/87 |
| 7,229,159 | B2 * | 6/2007 | Chikamoto et al. | 347/65 |
| 7,661,798 | B2 * | 2/2010 | Mukai et al. | 347/56 |
| 7,922,311 | B2 * | 4/2011 | Chikamoto et al. | 347/93 |
| 8,403,457 | B2 * | 3/2013 | Frazier et al. | 347/36 |
| 2002/0057320 | A1 * | 5/2002 | Kaga et al. | 347/92 |
| 2002/0109760 | A1 * | 8/2002 | Miyazawa et al. | 347/86 |
| 2004/0257415 | A1 * | 12/2004 | Arakawa et al. | 347/93 |
| 2005/0030358 | A1 * | 2/2005 | Haines et al. | 347/93 |
| 2007/0052780 | A1 * | 3/2007 | Mizutani et al. | 347/93 |
| 2007/0153070 | A1 * | 7/2007 | Haines et al. | 347/93 |
| 2007/0229633 | A1 * | 10/2007 | Wada | 347/93 |
| 2007/0229635 | A1 * | 10/2007 | Taira et al. | 347/93 |
| 2007/0252877 | A1 * | 11/2007 | Okubo | 347/93 |
| 2008/0122901 | A1 * | 5/2008 | Platt et al. | 347/85 |
| 2010/0110155 | A1 * | 5/2010 | Delueg | 347/93 |
| 2010/0231669 | A1 * | 9/2010 | Ito | 347/92 |
| 2011/0199445 | A1 * | 8/2011 | Ito | 347/93 |
| 2011/0279607 | A1 * | 11/2011 | Yamamoto et al. | 347/93 |

FOREIGN PATENT DOCUMENTS

| | | |
|---|---|---|
| JP | 06-143602 A | 5/1994 |
| JP | 11-010904 A | 1/1999 |

* cited by examiner

*Primary Examiner* — Matthew Luu
*Assistant Examiner* — Patrick King
(74) *Attorney, Agent, or Firm* — Kilpatrick Townsend & Stockton LLP

(57) ABSTRACT

There is disclosed a liquid ejecting head having a configuration in which a cross-sectional area of an intermediate passage is smaller than that of an upstream passage and a downstream passage to cause a flow speed of ink to be faster in the intermediate passage when the ink flows toward the downstream passage via the intermediate passage without passing through a filter, thereby making it possible to flow air bubbles staying on a face of the filter together with the ink.

4 Claims, 5 Drawing Sheets

LIQUID EJECTING HEAD AND LIQUID EJECTING APPARATUS

The entire disclosure of Japanese Patent Application No. 2010-58532, filed Mar. 15, 2010, is expressly incorporated herein by reference.

BACKGROUND

1. Technical Field

The present invention relates to liquid ejecting heads and liquid ejecting apparatuses.

2. Related Art

Ink jet recording heads have a problem such that when air bubbles residing in ink are supplied to a head body, the air bubbles can cause an ink discharge defect such as a dot missing. In order to solve such problem, an ink jet recording head in which a filter is disposed in an ink passage is proposed by JP-A-11-10904, for example. The filter in the ink passage removes air bubbles in the ink so as to prevent the air bubbles from flowing into the head body.

Meanwhile, as an ink jet recording head that discharges a high-viscosity ink, JP-A-06-143602 discloses an ink jet recording head that is configured such that ink which has not been discharged from nozzles is circulated through an external tank or the like and is supplied again to an ink passage from the external tank. Further, as a head body of an ink jet recording head, there is known a head body that includes a lead-out passage from which the ink, which has been supplied from an upstream passage and passed through a filter, is supplied to nozzles and also includes a downstream passage which circulates the ink, which has not passed through the filter, to the tank.

In an ink jet recording head equipped with such head body, a filter is arranged in parallel to a passage in which ink flows toward the tank without passing through the filter. As a result, an area of the filter to trap foreign objects becomes larger without making the size of a passage forming member be large in a width direction thereof. This makes it possible to suppress a pressure loss and surely trap the foreign objects.

However, it actually takes place even in the ink jet recording head equipped with the above-mentioned head body that air bubbles flow into the ink passage and block the passage to cause unfavorable effects on ink discharge. To be more specific, in order to suppress a pressure loss, and the like, the filter is arranged in parallel to the ink passage in which the ink that does not pass through the filter flows toward the tank. As a result, it is difficult to provide a method for removing the air bubbles in such configuration. Therefore, a requirement for a technique to remove the air bubbles has been greatly increased these days.

SUMMARY

An advantage of some aspects of the invention is to provide a liquid ejecting head that is capable of suppressing unfavorable effects by air bubbles even if a filter is arranged in parallel to a passage which circulates liquid without making the liquid pass through the filter.

Another advantage of some aspects of the invention is to provide a liquid ejecting apparatus equipped with the liquid ejecting head that is capable of suppressing the unfavorable effects by air bubbles even if the filter is arranged in parallel to the passage which circulates liquid without making the liquid pass through the filter.

A liquid ejecting head according to an aspect of the invention includes: a head body having a nozzle opening; a filter having a predetermined area; an upstream passage that is arranged on an upstream side of the filter and supplies liquid onto a face of the filter; a downstream passage to which the liquid that does not pass through the filter is flowed; an intermediate passage that is arranged between the upstream passage and the downstream passage and flows the liquid which does not pass through the filter in parallel to the filter; and a lead-out passage to which the liquid that has passed along the face of the filter is flowed and from which the liquid is led out to the head body. Further, a cross-sectional area of the intermediate passage is made smaller than that of the upstream passage and the downstream passage.

Another aspect of the invention is a liquid ejecting apparatus equipped with the liquid ejecting head according to the above-mentioned aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
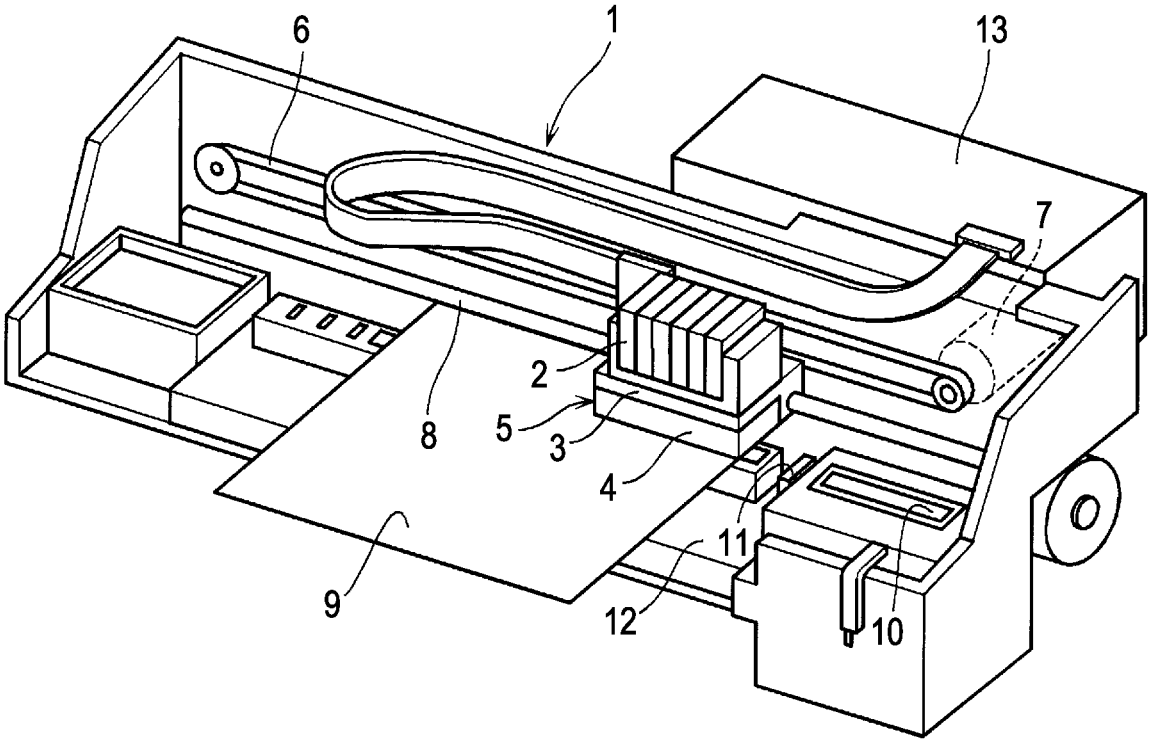
FIG. 1 is a view schematically illustrating a configuration of an ink jet recording apparatus according to the invention.

An ink jet recording apparatus according to an embodiment of the invention will be described with reference to FIG. 1. FIG. 1 schematically illustrates an overall configuration of the ink jet recording apparatus.

As shown in FIG. 1, the ink jet recording apparatus (apparatus body) 1 includes an ink ejecting head 5 as a head body where a carriage 3 in which ink cartridges 2 are mounted, a recording head 4 attached to the carriage 3 and the like are integrally installed. The carriage 3 is connected to a stepping motor 7 through a timing belt 6 and reciprocates in a width direction of a recording sheet 9 (main scanning direction) guided by a guide bar 8. The carriage 3 is formed in a box-shape which is open to the upper side, and is installed so that a nozzle face of the recording head 4 is exposed to a surface facing the recording sheet 9 (lower surface). Further, the ink cartridges 2 are accommodated in the carriage 3.

Ink is supplied from the ink cartridge 2 to the recording head 4 (ink ejecting head 5). The recording head 4 discharges ink droplets onto the upper surface of the recording sheet 9 along with the movement of the carriage 3 to print images and letters on the recording sheet 9 in a dot matrix fashion. With regard to numerals in FIG. 1, the numeral 10 indicates a cap that seals nozzle openings of the recording head 4 during a non-printing period to protect the nozzles from drying and also makes a negative pressure be applied to the nozzle face of the recording head 4 to perform a cleaning operation. The numeral 11 indicates a wiper blade that performs a wiping operation on the nozzle face of the recording head 4, the numeral 12 indicates a waste-ink storage to store the waste-ink sucked in the cleaning operation, and the numeral 13 indicates a controller that controls operations of the apparatus body 1.

A passage for ejecting ink, supplied from the ink cartridge 2 to the nozzle openings, is formed in the ink ejecting head 5 shown in FIG. 1. The passage of ink is configured of two pathways: a pathway in which ink passes through a filter and flows to the nozzle openings and a pathway in which ink circulates without passing through the filter. Details of the passage of ink will be described later.

In FIG. 1, an example in which the ink cartridge 2 as a fluid source is accommodated in the carriage 3 is described. However, the invention can be also applied to an ink jet recording apparatus having a configuration in which an ink cartridge is accommodated in a place other than the carriage 3, while ink is supplied through a supply tube in a pressurized manner.

Figure 2:
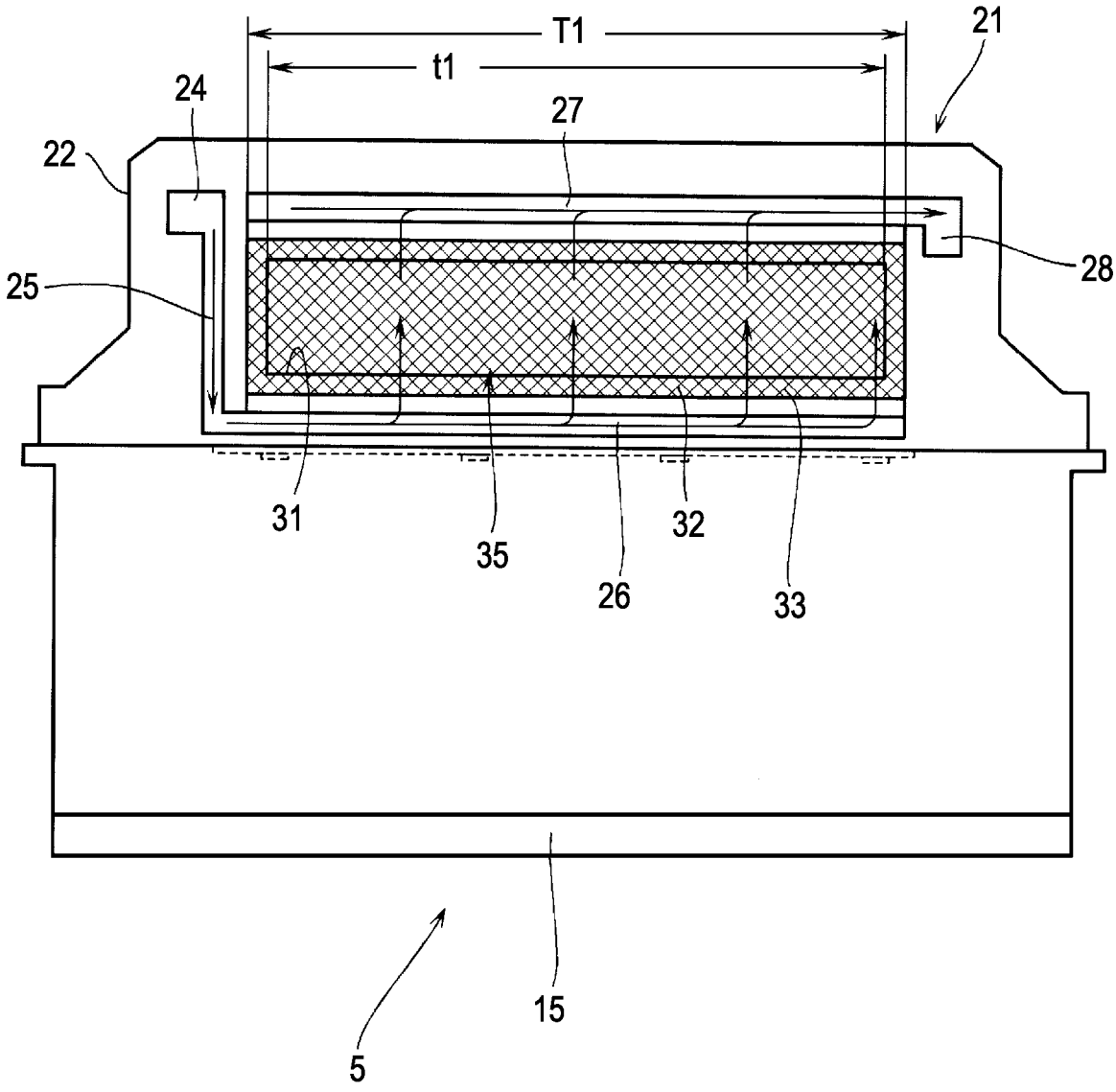
FIG. 2 is a side view of an ink ejecting head according to the invention.

The ink ejecting head 5 will be described with reference to FIG. 2. FIG. 2 is a side view illustrating the overall ink ejecting head, where a cross-sectional view of a passage forming member is shown. The passage forming member is a main part of the ink ejecting head.

As shown in FIG. 2, the ink ejecting head 5 is provided with, for example, a pressure generation unit such as a piezoelectric device, and discharges ink droplets from the nozzle openings arranged in a nozzle plate 15 using the pressure generated by displacement of the piezoelectric device. A reservoir is disposed in the ink ejecting head 5 and a passage forming member 21 is fixed on the upper portion of the ink ejecting head 5. Ink as a fluid is supplied from the passage forming member 21 to a head passage of the ink ejecting head 5, from which the ink is supplied to the reservoir.

Ink is supplied from the ink cartridge 2 to the passage forming member 21. For example, the ink is supplied from the ink cartridge 2 through a supply tube or a supply needle to the passage forming member 21. That is, a liquid ejecting head is configured of the ink ejecting head 5 as the head body and the passage forming member 21.

Figure 3:
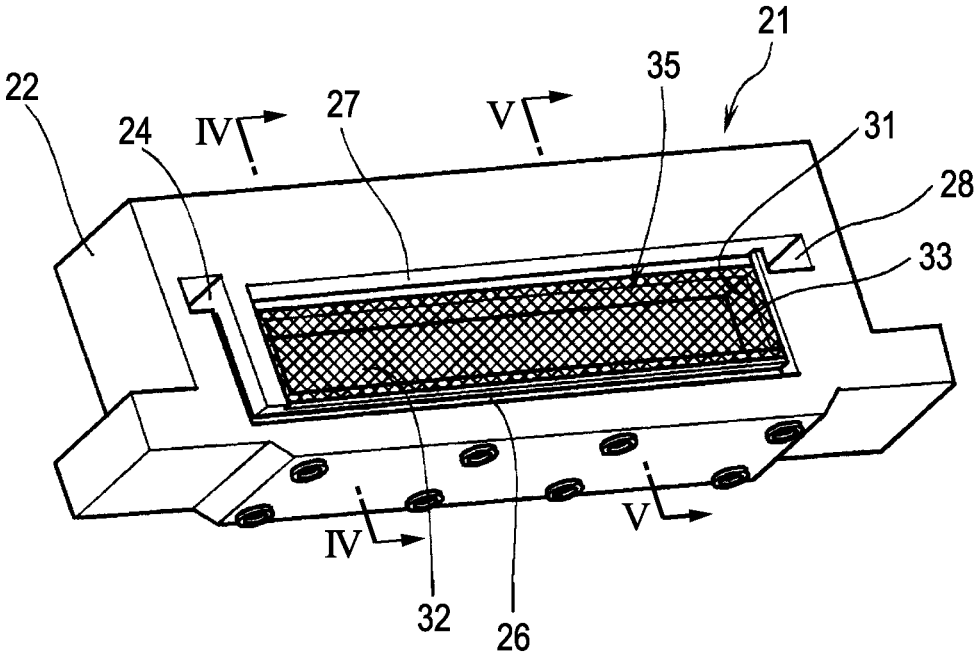
FIG. 3 is a perspective view illustrating a main part of the ink ejecting head according to the invention.
Figure 4:
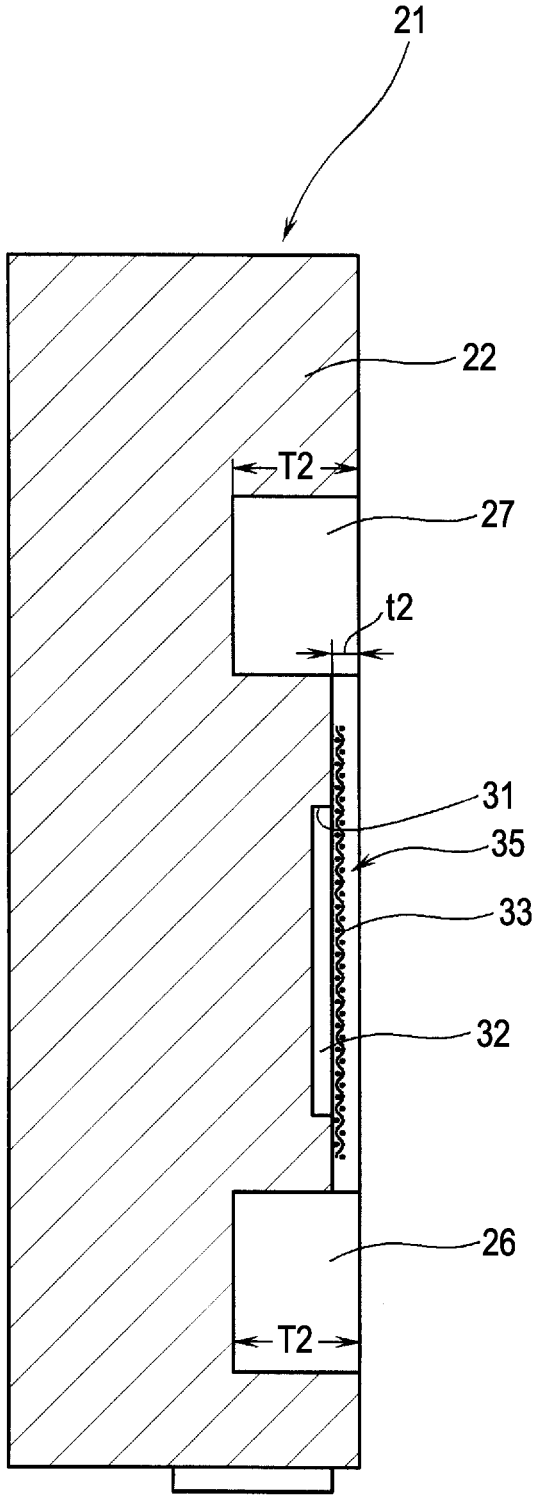
FIG. 4 is a diagram viewed from an arrow IV-IV line in FIG. 3.
Figure 5:
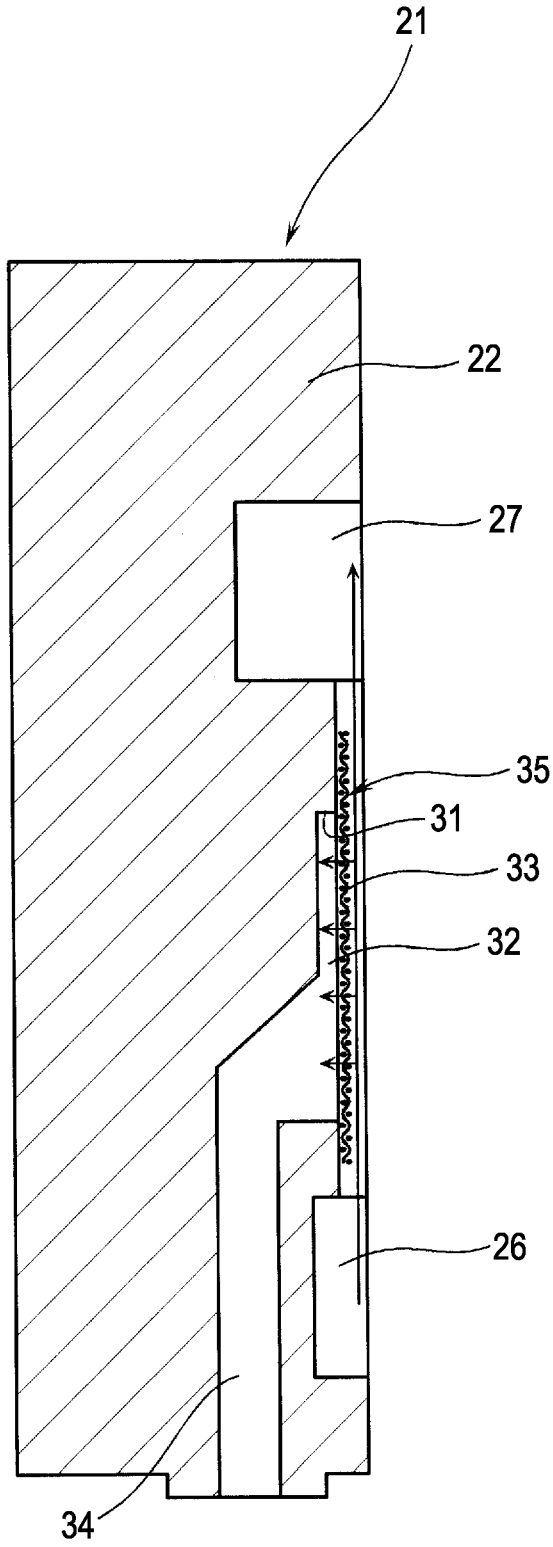
FIG. 5 is a diagram viewed from an arrow V-V line in FIG. 3.

With reference to FIGS. 2 through 5, details of the passage forming member 21 will be described. FIG. 3 illustrates an appearance of the passage forming member 21, which constitutes a main part of the ink ejecting head. FIG. 4 is a cross-sectional view in a vertical direction of a portion where a lead-out passage is not present in FIG. 3 (viewed from an arrow IV-IV line), while FIG. 5 is a cross-sectional view in the vertical direction of a portion where the lead-out passage is present in FIG. 3 (viewed from an arrow V-V line).

The passage forming member 21 is formed in a rectangular parallelepiped block shape having rectangular board faces. Films are welded to both the board faces of a main body 22 which is made of a resin so as to form passages at both the board face sides. As the passages formed at both the board face sides are in the same configuration, the passage at one board face side is explained below.

An inlet passage 25 to which ink is supplied from an inlet opening 24 is disposed in the main body 22. The inlet passage 25 is formed extending in an up-and-down direction in the vicinity of one edge portion of the main body 22. The ink is supplied from the inlet opening 24 downward in FIG. 2. At a lower portion of the inlet passage 25, an upstream passage 26 extending in a lengthwise direction (right-and-left direction in FIG. 2) of the main body 22 (board face) is disposed on a board face of the main body 22.

At the upper side of the board face of the main body 22, a downstream passage 27 extending in the lengthwise direction (right-and-left direction in FIG. 2) of the main body 22 (board face) is disposed. At the other edge portion of the main body 22, i.e., a side opposite to the inlet passage 25, a discharge passage 28 is disposed that discharges ink to a circulation pathway (not shown).

An opening portion 31 is formed between the upstream passage 26 and the downstream passage 27 in the board face of the main body 22. A filter-downstream passage 32 is arranged behind the opening portion 31. A filter 33 is provided on the front side of the opening portion 33. Ink that passes along a face of the filter 33 is flowed to the filter-downstream passage 32.

A lead-out passage 34 that leads out the ink, which has passed through the filter 33, to the ink ejecting head 5 is connected to the filter-downstream passage 32. A plurality of lead-out passages 34 are formed in the lengthwise direction of the main body 22 (right-and-left direction in FIG. 2). In other words, the plurality of lead-out passages 34 are disposed in a parallel arrangement direction of the nozzle openings of the nozzle plate 15 in the ink ejecting head 5 (right-and-left direction in FIG. 2).

An intermediate passage 35 is formed between the upstream passage 26 and downstream passage 27 on a face side of the filter 33 in the main body 22 (opposite to the side of the filter-downstream passage 32). The intermediate passage 35 flows the ink that does not pass along the face of the filter 33, from the upstream passage 26 to the downstream passage 27. The intermediate passage 35 is a passage that is formed in a rectangular shape in a state covering the filter 33, and is shut off from the outside by a film member (not shown) or the like. Further, the intermediate passage 35 flows the ink that does not pass through the filter 33 in parallel to the face of the filter 33.

The opening portion 31 (filter 33) is formed in a shape which has longer sides extending in a lengthwise direction (right-and-left direction in FIG. 2) and has shorter sides extending in a breadthwise direction (up-and-down direction in FIG. 2) in accordance with the board face of the main body 22. A lower lengthwise side of the intermediate passage 35 fluidly communicates with the upstream passage 26 along a lengthwise direction thereof, while an upper lengthwise side of the intermediate passage fluidly 35 communicates with the downstream passage 27 along a lengthwise direction thereof. Accordingly, the ink from the upstream passage 26 flows through the intermediate passage 35 upward in FIG. 2 in the breadthwise direction of the filter 33 to the downstream passage 27.

As shown in FIG. 2, a length T1 of the filter 33 in the lengthwise direction (right-and-left direction in FIG. 2) is larger than a dimension t1 of the lead-out passage 34 in an arrangement direction thereof (length in the parallel arrangement direction).

As shown in FIG. 4, a width t2 of the intermediate passage 35 in a cross-sectional direction is sufficiently smaller than a width T2 of the upstream passage 26 and the downstream passage 27 in the cross-sectional direction, whereby a cross-sectional area of the intermediate passage 35 is smaller than that of the upstream passage 26 and the downstream passage 27. This makes it possible to make a flow speed of ink be faster in the intermediate passage 35 when the ink is flowed from the upstream passage 26 to the downstream passage 27.

In the above-described passage forming member 21, the ink supplied from the inlet opening 24 into the inlet passage 25 is guided from the upstream passage 26 to the filter-downstream passage 32 via the filter 33, and is supplied to the ink ejecting head 5 through the lead-out passage 34. On the other hand, the ink that does not pass through the filter 33 is guided from the upstream passage 26 to the intermediate passage 35 (arrowed lines in FIG. 2), from which the ink is guided to flow in parallel with the face of the filter 33 toward the downstream passage 27 (arrowed lines in FIG. 2); then the ink is supplied to the circulation pathway (not shown) from the discharge passage 28.

Since the cross-sectional area of the intermediate passage 35 is smaller than that of the upstream passage 26 and the downstream passage 27, the flow speed of ink becomes faster in the intermediate passage 35 when the ink that does not pass along the face of the filter 33 flows from the upstream passage 26 through the intermediate passage 35. Accordingly, air bubbles staying on the face of the filter 33 can be flowed together with the ink so that the air bubbles will not remain on the filter 33.

Therefore, it is possible to prevent unfavorable effects such as clogging caused by air bubbles even when the intermediate passage 35 and the filter 33 are arranged in parallel to each other. In addition, regardless of a posture angle of the passage forming member 21 (ink ejecting head 5), i.e., an angle of the face of the filter 33, air bubbles on the face of the filter 33 can be flowed together with ink. This makes it possible to prevent the air bubbles from remaining on the face of the filter 33.

Even if the face of the filter 33 is arranged horizontally in accordance with the posture angle of the ink ejecting head 5, for example, because the cross-sectional area of the intermediate passage 35 is smaller than that of the upstream passage 26 and the downstream passage 27, the flow speed of ink becomes faster in the intermediate passage 35 so that the air bubbles are flowed together with the ink against buoyancy thereof. Accordingly, the air bubbles will not remain on the face of the filter 33.

The filter 33 is formed in a shape which has the longer sides extending in the lengthwise direction and has the shorter sides extending in the breadthwise direction. Since ink is flowed through the intermediate passage 35 in the breadthwise direction of the filter 33, a length of ink flow path in the intermediate passage 35 can be shortened. This makes it possible to flow the air bubbles staying on the face of the filter 33 with certainty.

In addition, the length T1 of the filter 33 in the lengthwise direction is larger than the arrangement dimension t1 of the lead-out passage 34 (length in the parallel arrangement direction). That is, since the length of the upstream passage 26 is larger, the length of the upstream passage 26 is set larger than the arrangement dimension t1 of the lead-out passage 34. This makes it possible to make the meniscus back-pressure be equal at each nozzle opening so as to cause each of the nozzle openings to uniformly discharge the ink.

Note that the above placement of the inlet opening 24 and the discharge passage 28 is an example. It is also possible to place both the inlet opening 24 and the discharge passage 28 at one side of the main body in accordance with a shape of the passage forming member 21 or the like. Although the filter 33 is exemplified above as having a rectangular shape, the filter 33 may appropriately adopt other shapes, such that the size of the filter 33 in the lengthwise direction becomes gradually smaller as it progresses toward the downstream passage 27. In addition, in order to suppress unevenness in pressure distribution of the ink that flows on the face of the filter 33, it is also possible to make a change in the shape of the upstream passage 26 such that the width of the passage from the inlet opening 24 becomes gradually larger.

In the above embodiment, even if the filter 33 is arranged in parallel to the intermediate passage 35 that circulates the ink which does not pass through the filter 35, air bubbles do not remain on the filter 33 and consequently, unfavorable effects by the air bubbles are suppressed.

Although in the above embodiment, an ink jet recording head is described as an example of a liquid ejecting head, the invention covers a wide range of generic liquid ejecting heads and can be applied to liquid ejecting heads that discharge liquid other than ink. The following can be cited as examples of the liquid ejecting heads that discharge liquid other than ink: various types of recording heads used in image recording apparatuses such as a printer; color material ejecting heads used for manufacturing color filters of a liquid crystal display and the like; electrode material ejecting heads used for forming electrodes of an EL display, a field emission display (FED) and the like, bioorganic compound ejecting heads used for manufacturing biochips; and the like.

What is claimed is:

1. A liquid ejecting head comprising:

a head body including a nozzle opening;

a filter having a predetermined area;

an upstream passage that is arranged on an upstream side of the filter and is fluidly communicated with a face of the filter;

a downstream passage to which the liquid that does not pass through the filter is flowed;

a filter-downstream passage to which the liquid that has passed through the face of the filter is flowed and from which the liquid is led out to the head body; and an intermediate passage that is arranged between the upstream passage and the downstream passage, the face of the filter forming a side wall of the intermediate passage so that the fluid flowing through the intermediate passage from the upstream passage to the downstream passage flows over the face of the filter so as to inhibit the accumulation of bubbles on the face of the filter, the filter separating the intermediate passage from the filter-downstream passage, wherein a thickness of the intermediate passage in a direction opposing the face of the filter is smaller than a thickness of the upstream passage and the downstream passage in the same direction as the direction of the thickness of the intermediate passage.

2. The liquid ejecting head according to claim 1, wherein:

the filter is formed in a shape which has longer sides extending in a lengthwise direction and has shorter sides extending in a breadthwise direction; and the liquid is flowed through the intermediate passage in the breadthwise direction of the filter.

3. The liquid ejecting head according to claim 2, wherein:

the head body includes a plurality of nozzle openings;

a plurality of lead-out passages are arranged in a parallel arrangement direction of the nozzle openings and;

a dimension of the upstream passage in the lengthwise direction of the filter is larger in comparison with the arrangement dimension of the filter-downstream passage.

4. A liquid ejecting apparatus comprising: the liquid ejecting head according to claim 1.

* * * * *